US006536285B2

(12) United States Patent
Watanabe et al.

(10) Patent No.: US 6,536,285 B2
(45) Date of Patent: Mar. 25, 2003

(54) PRESSURE CAP

(75) Inventors: Kazuhiro Watanabe, Hadano (JP); Hisae Nishikawa, Hadano (JP); Takashi Nohara, Hadano (JP)

(73) Assignee: Toyo Radiator Co., Ltd., Tokyo (JP)

( * ) Notice: Subject to any disclaimer, the term of this patent is extended or adjusted under 35 U.S.C. 154(b) by 0 days.

(21) Appl. No.: 09/887,170

(22) Filed: Jun. 25, 2001

(65) Prior Publication Data

US 2002/0035874 A1 Mar. 28, 2002

(30) Foreign Application Priority Data

Sep. 28, 2000 (JP) ..... 2000-297639

(51) Int. Cl.[7] ..... G01L 7/00
(52) U.S. Cl. ..... 73/706; 73/700
(58) Field of Search ..... 73/700, 756; 220/203.01, 220/203.11, 203.13, 203.14, 203.19, 203.29, 89.1

(56) References Cited

U.S. PATENT DOCUMENTS 3,086,677 A * 4/1963 Konchan ..... 220/203.07
3,111,239 A * 11/1963 Ivins ..... 220/231
3,715,049 A * 2/1973 McMullen et al. ..... 220/44 R
3,830,398 A * 8/1974 Shanklin ..... 220/202
5,929,330 A * 7/1999 Ford ..... 73/146.8
6,390,318 B1 * 5/2002 Tanaka et al. ..... 220/203.26
6,400,354 B1 * 6/2002 Pin-Chien ..... 345/161

FOREIGN PATENT DOCUMENTS

GB 0097443 * 4/1984 ..... F01P/11/02

* cited by examiner

*Primary Examiner*—Hezron Williams
*Assistant Examiner*—Andre Allen
(74) *Attorney, Agent, or Firm*—Sughrue Mion, PLLC

(57) ABSTRACT

A cap body of a synthetic resin includes a cylindrical portion having an external thread formed on its outer peripheral surface, the cylindrical portion having at its lower end a shoulder or an annular groove for receiving an O-ring. The cylindrical portion has on its inner peripheral surface an annular, internally flanged valve stopper which provides a support for a locking rib of a pressure valve. The pressure valve includes deformation slits formed along the outer periphery of a pot-shaped valve body, and a seal plate disposed on the bottom surface of the valve body.

7 Claims, 4 Drawing Sheets

Fig 8 PRIOR ART

PRESSURE CAP

BACKGROUND OF THE INVENTION

1. Field of the Invention

The present invention relates generally to a pressure cap removably fitted to an upper end of a tank of a heat exchanger for cooling automobile engine cooling water.

2. Description of the Related Art

A filler neck for water supply is disposed at the upper end of the tank of the heat exchanger for cooling the automobile engine cooling water. A pressure cap shown in FIG. 8 is removably fitted to the filler neck opening. A pressure valve 6 is suspended on the central underside of a cap body 3 by way of a suspension member 34 and a retainer 33, with a negative pressure valve 22 being provided centrally of the pressure valve 6. For the pressure valve 6, a tapered tubular connection metal fitting 38 is joined at its outer periphery to the inner peripheral surface of a pot-shaped valve body 14 having a central insertion hole, with its extremity being vertically displaceably guided by the retainer 33 in the shape of a temple bell.

A seal plate 15 is attached via a stem guide 28 to the under side of the valve body 14. A stem 35 is inserted into the stem guide 28 and the negative pressure valve 22 is secured to an extremity of the stem 35. Between the upper head of the stem 35 and the valve body 14 there is interposed a negative pressure spring 30. A seat plate 36 and a plate spring 31 are disposed at the upper end of the retainer 33, with a seal plate 32 clamped therebetween. A pressing spring 4 at its upper end is seated on the seat plate 36 and at its lower end is seated on the connection metal fitting 38. Reference numeral 40 denotes an aperture.

A flanged portion is formed at the upper edge of the filler neck of the heat exchanger tank that is fitted with the thus constructed pressure cap, the flanged portion having a locking cam face on which is locked a claw 41 of the cap body 3. The pressure valve 6 is then seated on the valve seat of the filler neck for press fitting.

When the internal pressure of the tank increases as a result of a rise of the cooling water temperature by the operation of the engine, the pressure valve 6 is raised against a spring force of the pressing spring 4 so that steam and high temperature cooling water are led into a surge tank through a pipe coupled to the filler neck. When the cooling water temperature drops as a result of halt of the engine, the interior of the tank goes negative allowing the negative pressure valve 22 to be displaced downward so that the cooling water within the surge tank can flow back into the interior of the heat exchanger tank by way of the aperture 40.

The conventional pressure cap involved a lot of constituent elements leading to an increased number of assembly steps, thus imposing size limitations. In addition, the presence of the pressure cap projecting from the upper end of the heat exchanger to a large extent placed restrictions on the layout upon the mounting of the heat exchanger on the motor vehicle.

SUMMARY OF THE INVENTION

It is therefore the object of the present invention to provide a compact pressure cap with a reduced number of constituent elements.

To attain the above object, according to an aspect of the present invention there is provided a pressure cap comprising a cap body removably fitted to a filler neck for water supply disposed at an upper end of a tank of a heat exchanger; and a pressure valve disposed on an inner surface of the cap body, the pressure valve being urged downward by a pressing spring, the pressure valve being releasably seated on a valve seat of the filler neck; the cap body including a cylindrical outer peripheral portion and a top closure portion that are integrally molded of resin, the cap body having on its outer peripheral surface an external thread mating with an internal thread formed in an opening of the filler neck, the cap body having at its outer peripheral lower end a shoulder or an annular groove for receiving an O-ring, the cylindrical portion having an annular, inwardly flanged valve stopper formed on its inner peripheral surface, the pressure valve including a pot-shaped valve body and a seal plate disposed on the bottom outer surface, the valve body having along its outer periphery a plurality of slits for deformation that extend from its upper edge toward the bottom surface, the valve body having at its upper edge a locking rib that extends outward, the locking rib having an external diameter larger than the internal diameter at the edge of the valve stopper, the external diameter of the locking rib being smaller than the internal diameter of portions above the valve stopper, the presence of the slits allowing the upper external diameter of the valve body to resiliently be contracted and deformed so that the locking rib can be mounted above the valve stopper, the cap body being screwed such that the O-ring mounted on the shoulder or annular groove of the cap body can be press fitted on the inner peripheral surface of the filler neck.

Preferably, the cap body includes a guide tapered surface whose diameter increases from the edge of the valve stopper downward.

The valve body may have an insertion hole located centrally of its bottom. The pressure cap may further comprise a negative pressure valve consisting of a circular plate-like portion and a centrally extending stem that are integrally molded of a resin, the stem being inserted into the insertion hole of the valve body.

Preferably, the valve body is made of a molded form of a synthetic resin, the valve body including a cylindrical stem guide that is integral with the insertion hole, the stem being inserted into the stem guide.

The valve body may be screwed such that a top surface of the cap body substantially coincides with an upper end face of the filler neck.

BRIEF DESCRIPTION OF THE DRAWINGS

The above and other objects, aspects, features and advantages of the present invention will become more apparent from the following detailed description when taken in conjunction with the accompanying drawings, in which:

FIG. 8 is a longitudinal sectional view of a conventional pressure cap.

DESCRIPTION OF THE PREFERRED EMBODIMENTS

Figure 1:
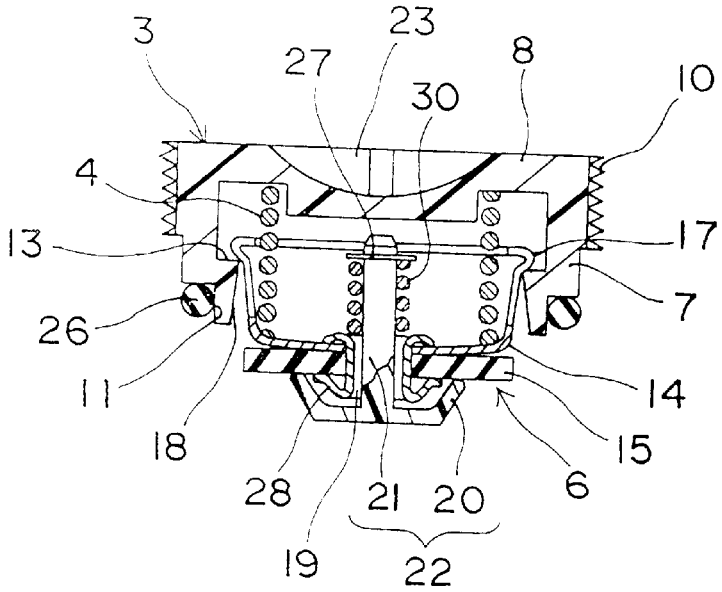
FIG. 1 is a longitudinal sectional view of a pressure cap in accordance with a first embodiment of the present invention.

The present invention will now be described with reference to the accompanying drawings which illustrate presently preferred embodiments thereof in a non-limitative manner.

In figures of the drawings, like reference numerals designate similar constituent elements to those of the conventional pressure cap.

Figure 2:
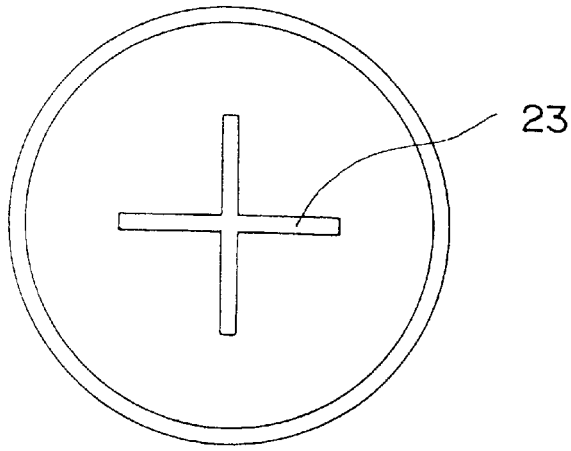
FIG. 2 is a top plan view of the pressure cap.
Figure 3:
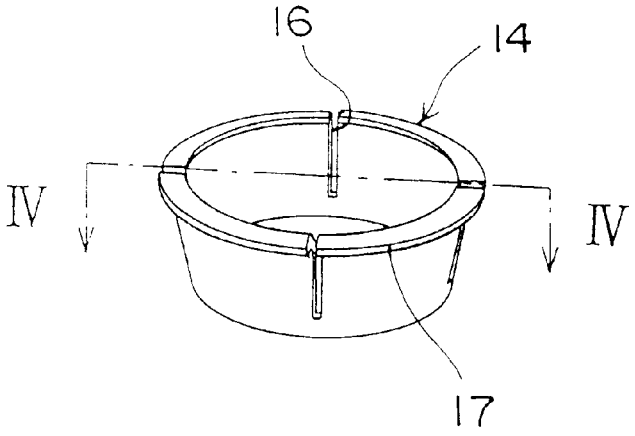
FIG. 3 is a perspective view of a valve body 14 for use in the pressure cap.
Figure 4:
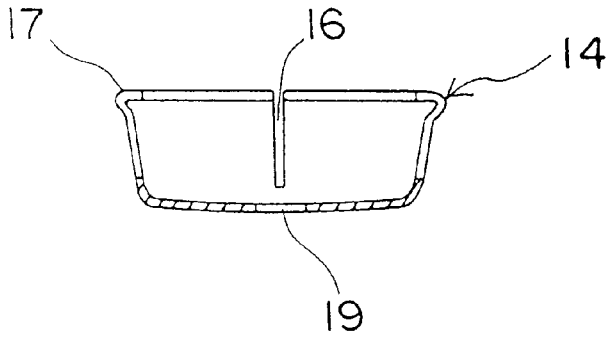
FIG. 4 is a perspective sectional view taken along a line IV—IV of FIG. 3.
Figure 5:
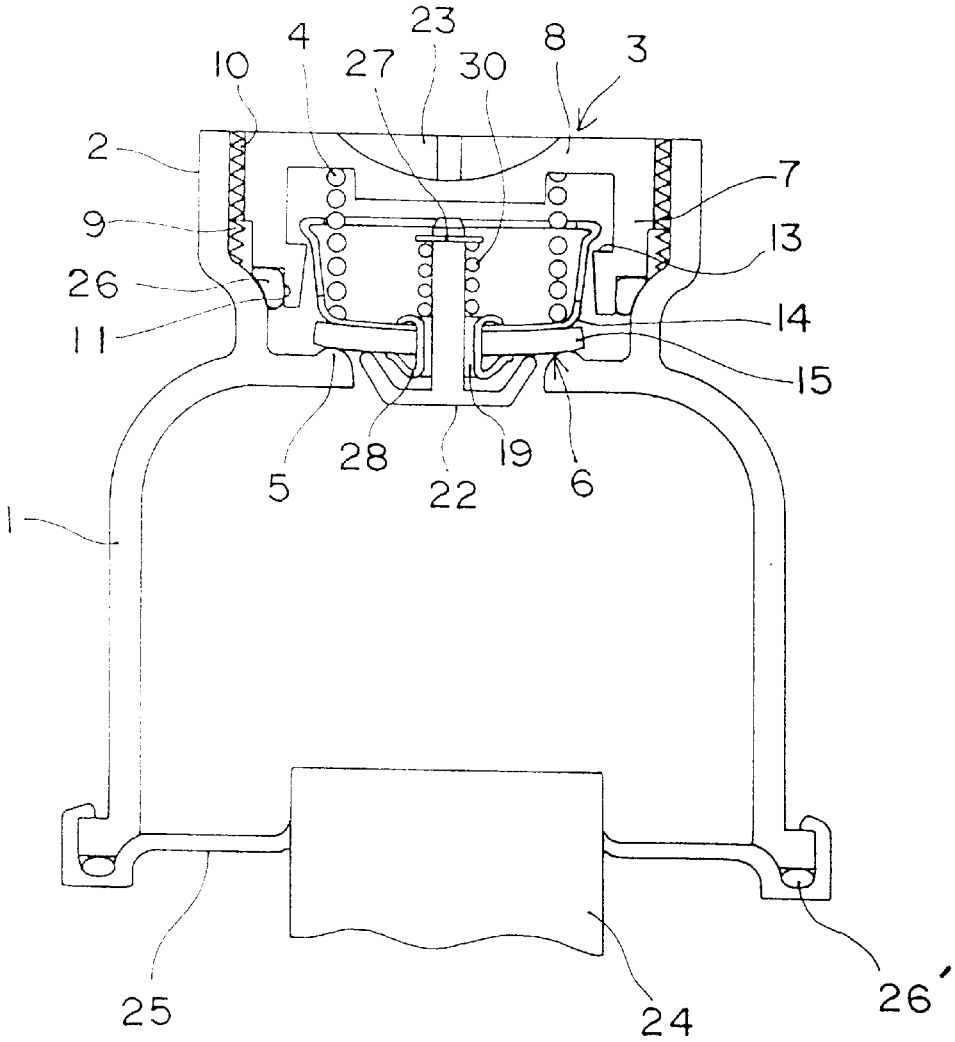
FIG. 5 is a longitudinal sectional view showing the state of mounting of the pressure cap.

FIG. 1 is a longitudinal sectional view of a pressure cap in accordance with the present invention; FIG. 2 is a top plan view of the same; FIG. 3 is a schematic perspective view of a valve body 14 for use in the pressure cap; and FIG. 4 is a sectional view taken along a line IV—IV of FIG. 3. FIG. 5 is a longitudinal section showing a state of fitting of the pressure cap.

The pressure cap comprises a cap body 3, a pressure valve 6 and a negative pressure valve 22. The cap body 3 includes a cylindrical portion 7 and a closure portion 8, the cylindrical portion 7 having an external thread 10 formed at its outer peripheral surface. The outer peripheral lower end of the cylindrical portion 7 is stepped and tapered toward its extremity to provide a shoulder 11 for receiving an O-ring. On the inner peripheral side of the cap body 3 there is a spring seat 27 provided in the inner surface of the closure portion 8, with an annular valve stopper 13 integral therewith that flanges slightly from the lower inner surface of the cylindrical portion 7. A guide tapered surface 18 extends upward from the extremity of the cylindrical portion 7 to the edge of the valve stopper 18.

The cap body 3 is made of a molded form of a synthetic resin and has a cross groove 23 provided in its top surface as depicted in FIGS. 1 and 2.

The valve body 14 is made of a press molded form of a metal plate such as a brass plate. The valve body 14 has a pot-shaped bottom including an insertion hole 19. The valve body 14 has an outer peripheral surface that includes a plurality of equi-angularly spaced slits 16 extending from its upper edge toward the bottom so that the outer peripheral surface is resiliently deformable in the axial direction thereof. The upper edge of the valve body 14 has an annular locking rib 17 that slightly extends outward in the radial direction, the top surface of the rib 17 being slightly bent toward the inner surface of the valve body 14.

The negative pressure valve 22 is made of a molded form of a synthetic resin and includes a circular plate-like portion 20 and a centrally extending stem 21 that are integrally formed with each other. The stem 21 has an upper end that includes a groove not shown for receiving the spring seat 27. The spring seat 27 can be formed by press fitting a spring fastener having a C-shape in plan.

The thus constructed pressure cap can be put together as follows by way of example.

First, a seal plate 15 is disposed on top of the bottom surface of the valve body 14 such that respective insertion holes are in registration with each other. A short cylindrical stem guide 28 is inserted into the insertion holes and the end of the stem guide 28 is caulked outward to allow the seal plate 15 to be retained on the outer surface of the valve body 14. Then, the stem 21 of the negative pressure valve 22 is inserted into the stem guide 28 and the stem 21 is mounted with a negative pressure spring 30 and fitted with the spring seat 27.

A pressing spring 4 is then inserted into the interior of the valve body 14, which in turn is press fitted through the lower end opening of the cylindrical portion 7 into the interior thereof. Thus, due to the provision of the plurality of slits 16 as depicted in FIGS. 3 and 4, the outer peripheral surface of the valve body 14 is resiliently deformed and contracted toward its center so as to be guided by the guide tapered surface 18 of the cylindrical portion 7, with the result that the locking rib 17 can climb over the valve stopper 13 for expansion. Then, the biasing force of the pressing spring 4 causes the locking rib 17 to be seated on the valve stopper 13.

The pressure cap is made of a molded form of a synthetic resin and is fitted to a filler neck 2 of a tank 1. As depicted in FIG. 5, the filler neck 2 includes a short cylindrical portion extending from its upper end opening, with its neck having an inner flanged portion whose edge is provided with a valve seat 5. The filler neck 2 has an internal thread 9 formed in its inner peripheral surface, the external thread 10 of the cap body 3 being screwed onto the internal thread 9. For the screwing, a tool end or a coin is fitted into the cross groove 23 formed in the top end face of the cap body 3 to thereby turn the cap body 3. Then, an O-ring 26 is press fitted on a neck portion of the filler neck 2 to provide a hermetic seal between the cap body 3 and the filler neck 2. Simultaneously, the seal plate 15 of the pressure valve 6 is seated on the valve seat 5 so that a water supply port of the tank can hermetically be blocked by the action of the pressing spring 4.

The tank 1 is in the shape of a box, with its lower end opening being liquid-tightly fastened via an O-ring 26' to a tube plate 25. The tube plate 25 communicates with a multiplicity of tubes 24 which are flat in this example. Corrugate fins not shown are firmly brazed to regions between the multiplicity of juxtaposed tubes 24.

When the internal pressure of the tank 1 exceeds a predetermined level as a result of a rise of the cooling water temperature during the operation of the engine, the pressure valve 6 is lifted against a spring force of the pressing spring 4. Then, there occurs a gap between the valve seat 5 and the seal plate 15, allowing a high-temperature cooling water or steam to flow therethrough into the interior of the filler neck 2. A pipe not shown is provided on the filler neck 2 and has a terminal end that communicates with a surge tank by way of a hose. This allows the cooling water or steam flowing into the filler neck 2 to be led into the surge tank.

On the contrary, when the engine comes to a stop and the cooling water temperature drops, the pressure within the tank 1 goes negative. Then, against a spring force of the negative pressure spring 30, the negative pressure valve 22 is displaced downward to allow the cooling water within the surge tank to flow into the tank 1.

Figure 7:
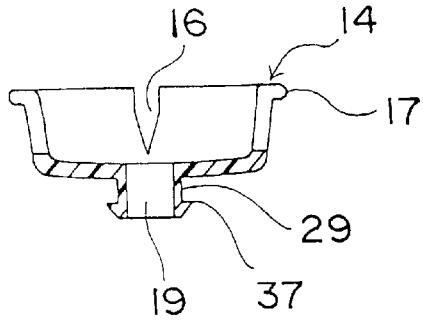
FIG. 7 is a longitudinal sectional view of the valve body 14 for use in the pressure cap.
Figure 6:
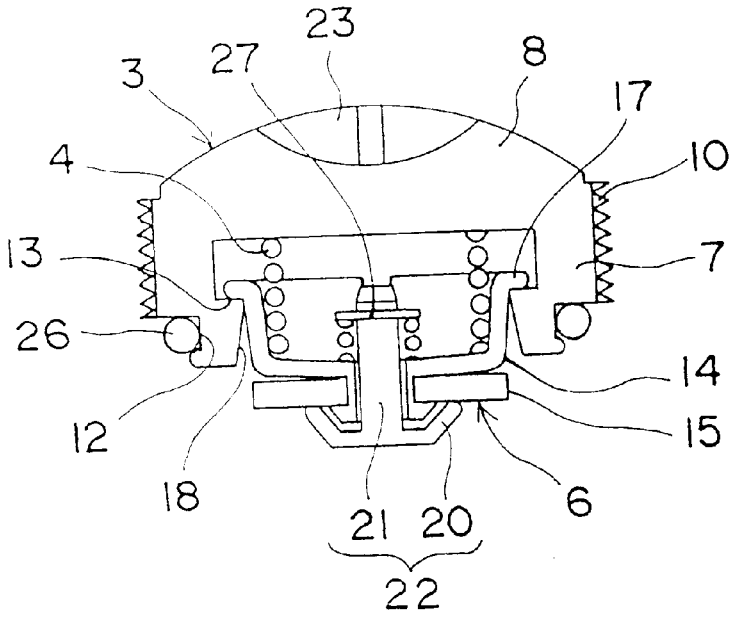
FIG. 6 is a longitudinal sectional view of a pressure cap in accordance with a second embodiment of the present invention.
Figure 6:
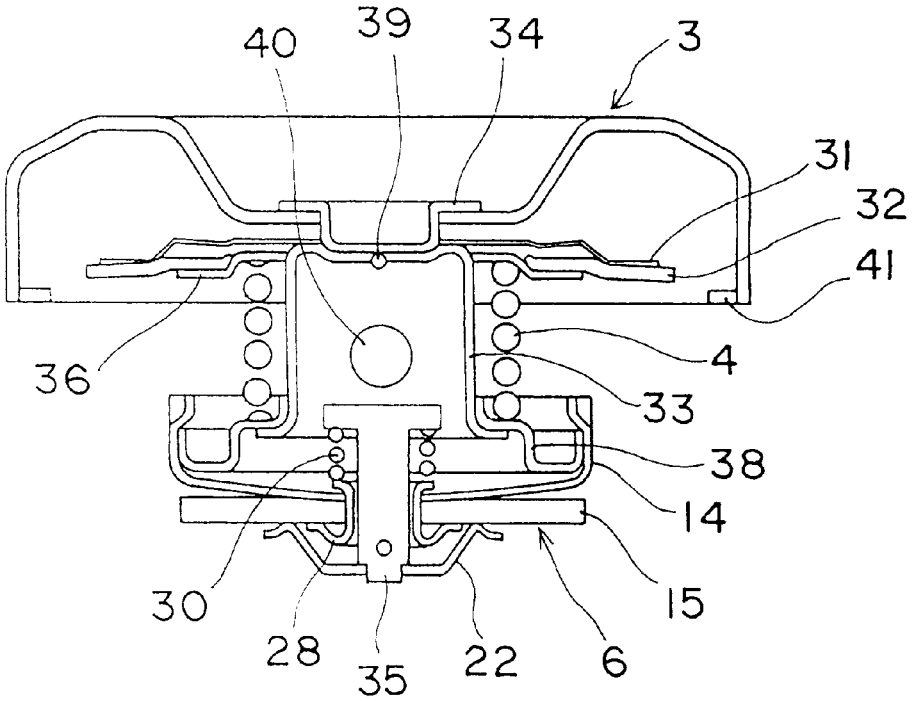

Referring then to FIG. 6 there is depicted another embodiment of the present invention. This example differs from the above embodiment in the construction of the valve body 14 in particular. As seen in FIG. 7, the valve body 14 is made of an integrally molded form of a synthetic resin and has the insertion hole 19 provided with a stem guide 29. The stem guide 29 has an annular claw 37 formed along its lower end peripheral edge. The outer periphery of the claw 37 is downwardly tapered.

In this example, the outer peripheral surface of the valve body 14 is formed with the slits 16 that are 90 degrees apart from one another so that the locking rib 17 is radially resiliently deformable. The seal plate 15 is then inserted into such a valve body 14 as depicted in FIG. 6 whereby the hole edge of the seal plate 15 is locked by the claw 37.

Furthermore, in this example, the annular groove 12 is provided in the lower end outer periphery of the cylindrical portion 7 of the cap body 3 so that the O-ring 26 is fitted in the annular groove 12.

According to the pressure cap of the present invention, it is possible to integrate a plurality of conventional elements into a single element to thereby reduce the dimensions of the pressure cap with a lesser number of constituent elements. In addition, the pressure cap is easy to assemble with a high productivity. This arises from the feature that the cap body 3 of the present invention is integrally molded from a synthetic resin with the formation of the slits 16 in the valve body to provide improved mounting or assembling properties to thereby eliminate the need for the suspension member 34, the retainer 33 and the connection metal fitting 38 which have hitherto been required in FIG. 8.

By virtue of formation of the guide tapered surface 18 to increase the diameter from the edge of the valve stopper 13 downward, it is more easy to mount the valve body 14 on the valve stopper 13.

In case of making up the negative pressure valve 22 from the circular plate-like portion 20 and the centrally extending stem 21 that are integrally molded, it is possible to further reduce the number of elements to facilitate the assembly.

In case of integrally providing the stem guide 29 in the insertion hole 19 of the resin molded valve body 14, an even easier assembly can be achieved.

While illustrative and presently preferred embodiments of the present invention have been described in detail herein, it is to be understood that the inventive concepts maybe otherwise variously embodied and employed and that the appended claims are intended to be construed to include such variations except insofar as limited by the prior art.

What is claimed is:

1. A pressure cap comprising:

a cap body removably fitted to a filler neck for water supply disposed at an upper end of a tank of a heat exchanger; and a pressure valve vertically movably disposed on an inner surface of said cap body, said pressure cap being releasably seated on a valve seat of said filler neck;

wherein said cap body includes a cylindrical outer peripheral portion and a top closure portion that is integrally molded of resin, said cap body having on its outer peripheral surface an external thread mating with an internal thread in an opening of said filler neck, said cap body having at its outer peripheral lower end an annular recessed portion for receiving an O-ring, said cylindrical portion having an annular, inwardly flanged valve stopper formed on its inner peripheral surface, wherein said pressure valve includes a pot-shaped valve body and a seal plate disposed toward a bottom outer surface of said valve body, said valve body having along its outer periphery a plurality of slits for transformation that extend from an upper edge toward the bottom surface, said valve body having at the upper edge a locking rib that extends radially outward, wherein said locking rib has an outer diameter larger than an inner diameter at an edge of said valve stopper, said outer diameter of said locking rib being smaller than an internal diameter of portions above said valve stopper, wherein the presence of said slits allows an upper external diameter of said valve body to resiliently be reduced and deformed so that said locking rib is mounted above said valve stopper, wherein a pressing spring is interposed between an inner surface of the bottom of said pressure valve and said closure portion of said cap body to urge said pressure valve downward, and wherein said cap body is screwed such that said O-ring received in said annular recessed portion is press fitted on an inner peripheral surface of said filler neck.

2. The pressure cap according to claim 1, wherein said cap body includes a guide tapered surface whose diameter increases from the edge of said valve stopper downward.

3. The pressure cap according to claim 1, wherein said valve body has an insertion hole located centrally of its bottom, said pressure cap further comprising:

a negative pressure valve including a circular plate-shaped portion and a centrally extending stem that are integrally molded of a resin, said stem being inserted into said insertion hole of said valve body.

4. The pressure cap according to claim 3, wherein said valve body is made of a molded form of a synthetic resin, said valve body including a cylindrical stem guide that is integral with said insertion hole, said stem being inserted into said stem guide.

5. The pressure cap according to claim 1, wherein said cap body is screwed such that a top surface of said cap body substantially coincides with an upper end face of said filler neck.

6. The pressure cap according to claim 1, wherein said annular recessed portion of said cap body is an annular groove.

7. The pressure cap according to claim 1, wherein said annular recessed portion of said cap body is a stair portion having an inverted-stair-shaped section whose diameter reduces toward the lower end of the outer periphery of said cap body.

* * * * *